US005560289A

United States Patent [19]

Pernsteiner

[11] Patent Number: 5,560,289

[45] Date of Patent: Oct. 1, 1996

[54] CONTAINER FOR COMPRESSING MATERIAL

[75] Inventor: Gerhard Pernsteiner, Leonding, Austria

[73] Assignee: Max Pernsteiner, Linz, Austria

[21] Appl. No.: 380,793

[22] Filed: Jan. 30, 1995

[51] Int. Cl.[6] ..... B30B 1/04

[52] U.S. Cl. ..... 100/34; 100/218; 100/233; 100/255; 100/283

[58] Field of Search ..... 100/34, 218, 226–228, 100/233, 250, 255, 281, 283, 293

[56] References Cited

U.S. PATENT DOCUMENTS

| | | | |
|---|---|---|---|
| 381,263 | 4/1888 | Liddell | 100/255 |
| 492,259 | 2/1893 | Barrett | 100/250 |
| 1,121,449 | 12/1914 | Babcock | 100/255 |
| 1,498,414 | 6/1924 | Widell | 100/218 |
| 1,728,089 | 9/1929 | Wallace | 100/255 |
| 2,970,533 | 2/1961 | Allen | 100/226 |
| 3,280,727 | 10/1966 | Jonas | 100/100 |
| 3,455,234 | 7/1969 | Foulke | 100/228 |
| 3,593,654 | 7/1971 | Mayfield | 100/34 |
| 3,613,566 | 10/1971 | Shapleigh, Jr. et al. | 100/218 |
| 3,726,211 | 4/1973 | Gladwin | 100/218 |
| 3,850,094 | 11/1974 | Shontz | 100/219 |

FOREIGN PATENT DOCUMENTS

| | | |
|---|---|---|
| 0006242 | 1/1980 | European Pat. Off. . |
| 0066840 | 12/1982 | European Pat. Off. . |
| 2419369 | 11/1975 | Germany . |
| 2102352 | 2/1983 | United Kingdom . |

*Primary Examiner*—Stephen F. Gerrity
*Attorney, Agent, or Firm*—Rothwell, Figg, Ernst & Kurz, P.C.

[57] ABSTRACT

A container of prismatic shape, in particular with a square ground plan shape, has a bottom, a base frame, and side walls extending upwardly therefrom, wherein a front side wall is pivotably journalled for opening the container, and wherein the container is furthermore equipped with a pressing device provided for compressing the filling material. At its lower side, the front side wall is rigidly connected to the bottom, and the unit thus formed is journalled on the front side of the container so as to be outwardly pivotable. The pressing device is comprised of a pressing lid and a toggle lever mechanism provided for pressing down the pressing lid and actuatable by a hand lever.

13 Claims, 2 Drawing Sheets

CONTAINER FOR COMPRESSING MATERIAL

BACKGROUND OF THE INVENTION

The invention relates to a container having a prismatic shape, and in particular a container having a square ground plan shape, a bottom, a base frame and side walls extending upwardly therefrom, wherein a pivotably journalled front side wall is provided for opening the container and the container is further equipped with a pressing device for compressing a filling material received therein.

It is an object of the invention to provide a container of the initially defined kind, which, with a structurally simple design, enables a compression of the filling material and a removal of the same in the compressed state in a simple manner and with little expenditure of force. In particular, the container to be provided shall be suitable for collecting and compacting of foil-type waste material.

SUMMARY OF THE INVENTION

The container of the invention of the initially defined kind is characterised in that the front side wall is rigidly connected on its lower side with the bottom of the container, and the unit thus formed by the front side wall and the bottom of the container is journalled in the container so as to be outwardly pivotable at the front side of the container; the pressing device is constituted by a pressing lid and a toggle lever means provided for pressing down the pressing lid and to be actuated by a hand lever. By this design the above-indicated object is well met.

A preferred embodiment of the container having a design of the toggle lever means which is structurally advantageous and easy to operate is characterised in that the pressing lid, at its side facing the rear side wall of the container, is pivotably journalled in the container, and the toggle lever means is constituted by a hand lever pivotably journalled in the container near the rear side wall thereof, and by a connecting rod having one end hinged to the hand lever, and another end hinged to the pressing lid. For operating the pressing device it is furthermore advantageous for the hand lever to be downwardly pressable to the dead center position of the toggle lever means, in which position the section of the hand lever extending from the journalling location of the hand lever to the hinging location of the connecting rod is in alignment with the connecting rod. In this manner, the toggle lever means, and with the same, the pressing lid can be kept in the pressed-down position very easily without necessitating special constructional measures or special actuation procedures therefor.

As regards the design of the toggle lever means, it is constructionally suitable, if the hand lever is angular in its longitudinal direction in the region of the hinging location of the connecting rod, the concave side of this angular design pointing upwardly.

For the design of the toggle lever means it is further advantageous in terms of easy movability and material-saving dimensioning, if the hand lever is a U-shaped bow which is pivotably journalled at the ends of its legs, to each one of the two legs a connecting rod being hinged, which connecting rods lead to hinging locations provided at the lateral rim of the pressing lid.

For handling the container, it is suitable if a catch means is provided on the pressing lid, which catch means catches in the upright position of the pressing lid for preventing an unintentional downward pivoting of the same.

Regarding the removal of the filling material collected and compressed in the container, it is advantageous if the front side wall, which is connected with the bottom of the container and is forwardly pivotable out of the container, is pivotably journalled on the base frame at the front side of the base frame of the container. In this respect, it is furthermore suitable if the front side wall, in its upper part, is provided with forwardly projecting, preferably bow shaped, handling means which also form steady legs in the outwardly pivoted state of the front side wall, which steady legs support the outwardly pivoted front side wall at the site where the container rests.

For the manipulation during compression of the filling material, it is furthermore advantageous if the front side wall, in its upper part, is provided with closing means constituting a connection to the side walls and preventing an unintentional outward pivoting during the pressing procedure. Furthermore, it is also advantageous, for the formation of easy-to-handle bales of the filling material compressed in the container, if the pressing lid is provided with accommodations for tying material.

BRIEF DESCRIPTION OF THE DRAWINGS

The invention will now be further explained by way of an embodiment schematically illustrated in the drawings, wherein.

DETAILED DESCRIPTION OF THE DRAWINGS

Figure 1:
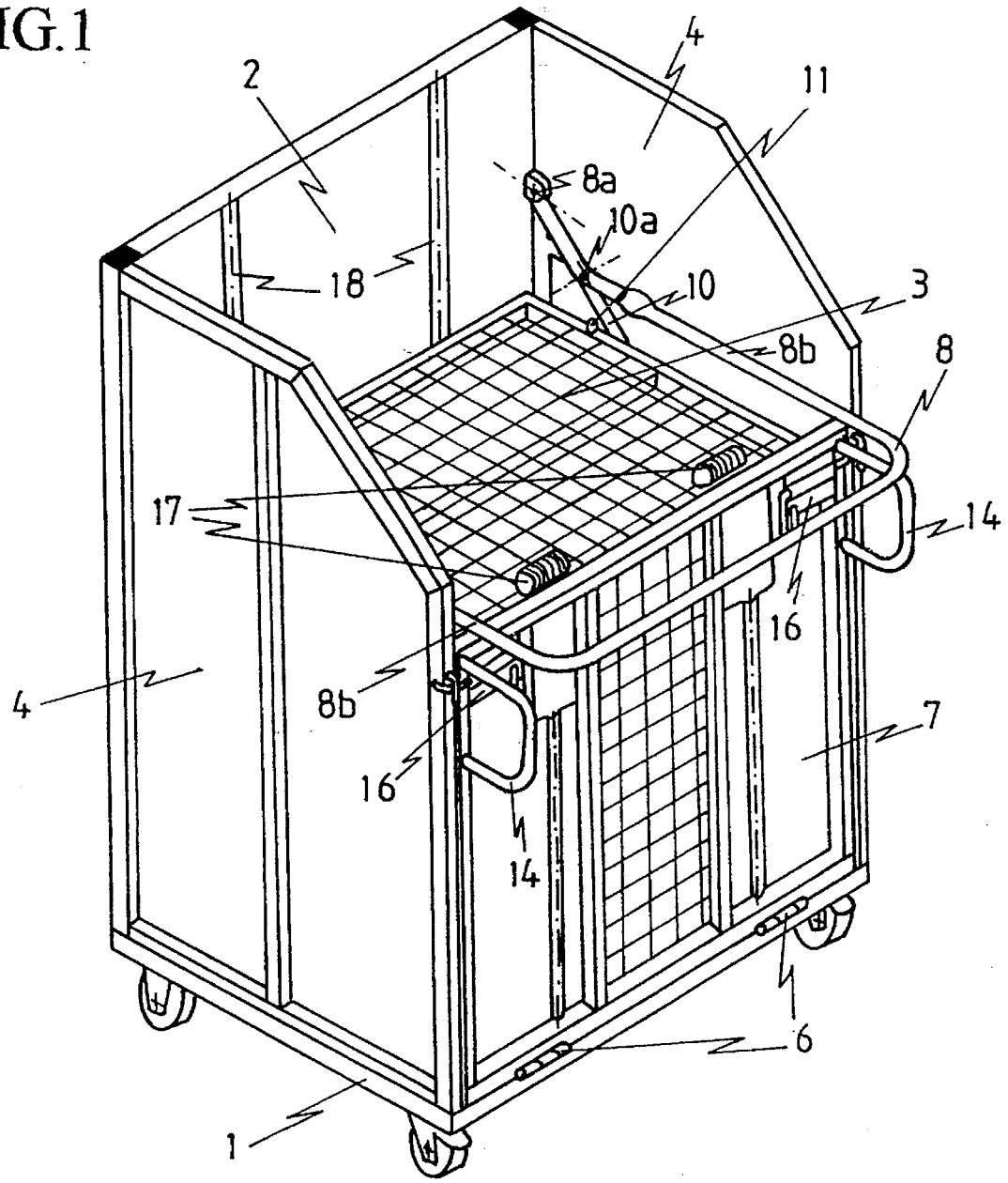
FIG. 1 shows an embodiment of the container designed according to the invention in an oblique view, the container being closed, and the pressing lid being pressed down.
Figure 2:
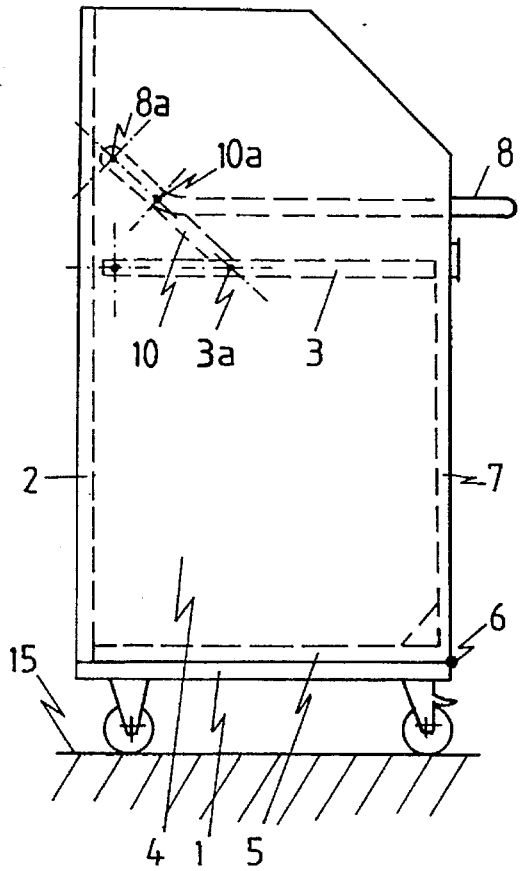
FIG. 2 shows the same container in the same state in a side view.

The container illustrated in the drawing has an approximately prismatic shape and an approximately square ground plan shape. This container has a base frame 1, from which side walls extend upwardly, i.e. the rear side wall 2, the front side wall 7 and the two lateral side walls 4. The front side wall 7 is pivotably journalled for opening of the container. For compressing the filling material which can be put into the container, a pressing lid 3 is provided, which, as can be seen from FIG. 3, can be tilted upwards, whereupon the container is open for the introduction of filling material, and can be pressed down into the position illustrated in FIGS. 1 and 2, whereby the filling material introduced into the container can be compacted. At its lower side, the front side wall 7 is rigidly connected with the bottom 5 of the container, and thus the unit formed by the front side wall 7 and the bottom 5 is journalled to be outwardly pivotable at the front side of the container, preferably, as illustrated, on the base frame 1 of the container. For this purpose, in the instance illustrated, hinges 6 are provided; such journalling may, however, be effected in a constructionally different manner, e.g. by a passed-through axle or by axle stubs. Similarly, if desired, the journalling can be provided for in the proximity of the bottom of the lateral side walls 4.

For pressing down the pressing lid 3, a toggle lever means is provided, which is constituted by a hand lever 8 pivotably journalled in the container near the rear side wall 2 and a connecting rod 10 journalled on the hand lever 8, on the one end, and on the pressing lid 3, on the other end. The pressing lid 3 is pivotably mounted in the container on its side facing the rear side wall 2 of the container. By pulling the hand lever 8 forward and pressing it down in the sense of the arrow 9 from the position illustrated in FIG. 3 into the position illustrated in FIGS. 1 and 2, the pressing lid 3 moves from the position illustrated in FIG. 3 into the position illustrated in FIGS. 1 and 2, wherein, due to the toggle lever characteristics, this downward pressing can be effected with a relatively slight expenditure of force. The hand lever 8 can be pressed down as far as to the dead center position of the toggle lever means illustrated in FIGS. 1 and 2, in which the section of the hand lever extending from the journalling location 8*a* of the hand lever to the journalling location 10*a* of the connecting rod 10 is in alignment with the connecting rod 10. In this dead center position of the toggle lever means, the pressing lid 3 is fixed in its pressed-down position. This fixation may be released by simple upward pivoting of the hand lever 8.

In the region of the hinging location 10*a* of the connecting rod, the hand lever 8 is angular in its longitudinal direction, the concave side of this angular shape pointing upwards. This shape yields favorable special and constructional conditions for arranging the individual construction parts of the toggle lever means.

By designing the hand lever as a U-shaped bow, as in the case illustrated, which bow is pivotably journalled on the ends of its legs 8*b*, one connecting rod 10 being hinged to each of the two legs 8*b*, which connecting rod leads to a hinging location 3*a* provided at the lateral rim of the pressing lid, the pressing lid can be easily operated during downward pressing of the pressing lid, while simultaneously the symmetry given thereby enables a material-saving structure of the toggle lever means.

Figure 3:
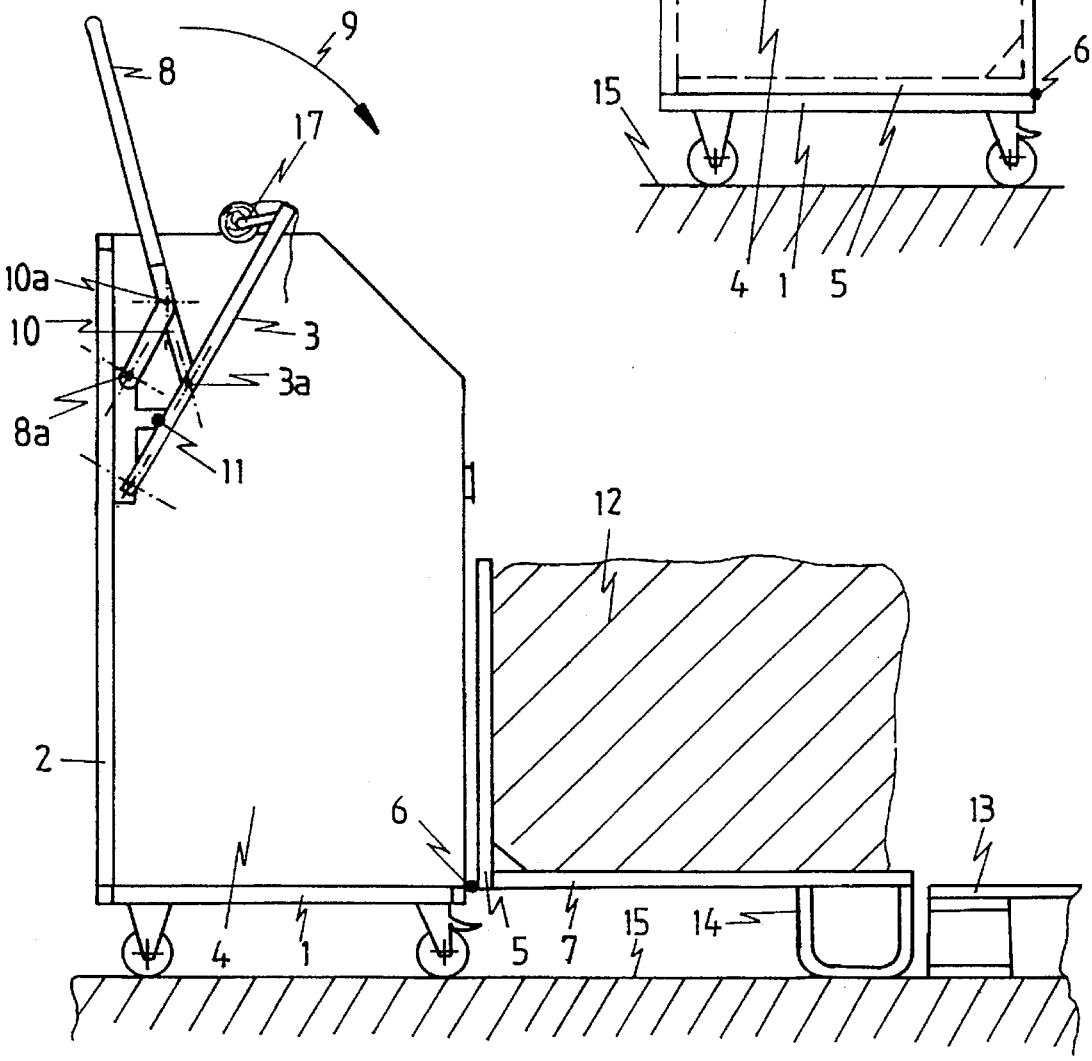
FIG. 3 shows the same container, also in a side view, yet for removal of the filling material in the open state, with the pressing lid upwardly pivoted.

A catch device 11 mounted on the pressing lid 3, which may, e.g., be formed as a ball catch, fixes the pressing lid caught in its upright position, as illustrated in FIG. 3, and prevents an unintentional downward pivoting of the pressing lid.

From FIG. 3 it can be seen how the front side wall. 7, which is connected with the bottom 5 of the container, can be forwardly pivoted out of the container so.as to remove the filling material that has been compressed to a bale 12 from the container in a simple manner. Such a bale 12 may then, e.g., be pushed onto a pallet 13 deposited in front of the container. For manipulation purposes, it is advantageous if the front side wall 7 in its upper part is provided with forwardly projecting handling means 14 which form steady legs in the outwardly pivoted state of the front side wall, which steady legs support the outwardly pivoted front side wall at the site 15 where the container rests. Such handling means may advantageously be bow-shaped, as in the case illustrated.

By connecting the front side wall 7 with the bottom 5 of the container, the front side wall is automatically kept in its closing position when the pressing lid 3 is pressed down. Yet, in terms of an easy operation of the container, it is advantageous to provide the front side wall 7 in its upper part with additional closing means 16 which provide for a connection of the front side wall 7 with the lateral side walls 4 and which prevent an unintentional outward pivoting of the front side wall during the compression procedure. To produce bales which are as compact and as easy to transport as possible from the filling material compressed in the container, tying up of the filling material is advantageously provided for by the invention. To allow for as easy tying as possible, holding means 17 for string bobbins are provided on the pressing lid 3. Furthermore, grooves or creases 18 are provided in the rear side wall, which grooves guide strings intended for tying up the filling material compressed in the container to the bottom region of the container, so that these strings may easily be wrapped around the compressed filling material.

What is claimed is:

1. A container having a prismatic shape and comprising: a container bottom, a base frame, side walls extending upwardly from said base frame and including a front side wall, a rear side wall and lateral side walls, said front side wall being rigidly connected at a lower side thereof to said container bottom so as to form a unit comprised of said front side wall and said container bottom, said unit being journalled in said container at the front side thereof so as to be outwardly pivotable for opening said container; and a pressing device for compressing filling material contained in said container, said pressing device including a pressing lid and toggle lever means for pressing down said pressing lid, said pressing lid being pivotably journalled in said container at a side of the pressing lid facing said rear side wall of said container, and said toggle lever means including a hand lever and a connecting rod, said hand lever being pivotably journalled in said container near said rear side wall of said container, and said connecting rod including a first end hinged to said hand lever and a second end hinged to said pressing lid.

2. A container as set forth in claim 1, wherein said container has a square ground plan shape.

3. A container as set forth in claim 1, wherein said hand lever is capable of being pressed down to the dead center position of said toggle lever means, and wherein said hand lever has a hand lever section extending from the journalling location of the hand lever to the hinging location of the connecting rod, said hand lever section being in alignment with said connecting rod in said dead center position of said toggle lever means.

4. A container as set forth in claim 1, wherein said hand lever has a longitudinal direction, and wherein said hand lever has an angular shape in said longitudinal direction in the region where said connecting rod is hinged to said hand lever, said angular shape having a concave side pointing upwards.

5. A container as set forth in claim 1, wherein said hand lever is a U-shaped bow including two legs with pivot means at their ends, one connecting rod each being hinged to each one of said legs, and wherein said pressing lid has a lateral rim including hinging locations for said connecting rods, each one of said connecting rods leading from the respective leg to its respective hinging location on said lateral rim of said pressing lid.

6. A container as set forth in claim 1, further comprising a catch means provided on said pressing lid catching in the upright position of said pressing lid and preventing an unintentional downward pivoting of said pressing lid.

7. A container as set forth in claim 1, wherein said front side wall connected to said container bottom and outwardly pivotable of said container is pivotably journalled on said base frame on the front side of said base frame of said container.

8. A container as set forth in claim 1, further comprising forwardly projecting handling means provided on the front side wall on the upper part therof, said handling means forming steady legs when said front side wall is in an outwardly pivoted state, which steady legs support said container at the site where the container rests.

9. A container as set forth in claim 8, wherein said handling means are bow-shaped.

10. A container as set forth in claim 1, further comprising closing means provided on said front side wall on the upper part therof so as to constitute a connection to the lateral side walls and to prevent an unintentional outward pivoting during the pressing procedure.

11. A container as set forth in claim 1, further comprising means provided on said pressing lid so as to accommodate a tying material.

12. A container comprising:

a container bottom, a base frame, side walls extending upwardly from said base frame and including a front side wall, a rear side wall and lateral side walls, wherein said front side wall on a lower side thereof is rigidly connected to said container bottom so as to form a unit comprised of said front side wall and said container bottom, said unit being journalled in said container at the front side thereof so as to be outwardly pivotable;

a pressing device movably connected to the container for compressing filling material contained in said container, said pressing device including a pressing lid and a toggle lever actuated by a hand lever for pressing down said pressing lid; and catch means on the pressing lid for catching said pressing lid in an upright position and preventing unintentional downward pivoting of said pressing lid.

13. A container comprising:

a container bottom, a base frame, side walls extending upwardly from said base frame and including a front side wall, a rear side wall and lateral side walls, wherein said front side wall on a lower side thereof is rigidly connected to said container bottom so as to form a unit comprised of said front side wall and said container bottom, said unit being journalled in said container at the front side thereof so as to be outwardly pivotable;

a pressing device movably connected to the container for compressing filling material contained in said container, said pressing device including a pressing lid and a toggle lever actuated by a hand lever for pressing down said pressing lid; and handling means projecting forwardly from an upper part of the front side wall for forming support legs when said front side wall is in an outwardly pivoted state which support the container at a site where the container rests.

* * * * *